United States Patent [19]

Jenkinson et al.

[11] Patent Number: 4,872,290

[45] Date of Patent: Oct. 10, 1989

[54] GLASSWARE GRINDING AND/OR POLISHING APPARATUS

[75] Inventors: Margaret Jenkinson, Blackpool, England; John Dunne, Dublin, Ireland

[73] Assignee: 501 Abbeybench Limited, Lancashire, England

[21] Appl. No.: 946,450

[22] Filed: Dec. 24, 1986

[30] Foreign Application Priority Data

Dec. 24, 1985 [GB] United Kingdom ..... 8531727

[51] Int. Cl.[4] ..... B24B 7/00

[52] U.S. Cl. ..... 51/109 R; 51/110; 51/283 R

[58] Field of Search ..... 51/110, 109 R, 134, 51/227, 107, 3, 4, 137, 138, 283 R, 283 E

[56] References Cited

U.S. PATENT DOCUMENTS

| | | | |
|---|---|---|---|
| 880,188 | 2/1908 | Blessing | 51/110 |
| 1,388,231 | 8/1921 | Zsarnay | 51/4 |
| 3,927,873 | 12/1975 | Chambers | 51/227 R |

*Primary Examiner*—Frederick R. Schmidt
*Assistant Examiner*—Lawrence Cruz
*Attorney, Agent, or Firm*—Richard E. Jenkins

[57] ABSTRACT

A glass grinding and/or polishing apparatus comprises a chuck which holds a glass to be repaired, and is rotated by means of a drive motor. The chuck is mounted in an arm which is arranged to move in an arcuate path over a substantially flat rotary grinding disc, and subsequently over a secondary grinding station and two polishing stations. During operation, fluid is continually circulated through a sealed enclosure of the apparatus, to flush away particles of glass, etc., which are collected as sediment in a disposable tank.

16 Claims, 5 Drawing Sheets

GLASSWARE GRINDING AND/OR POLISHING APPARATUS

This invention relates to the grinding and/or polishing of glassware.

In our copending U.K. Application No. 84 21075 (published as 2 147 530), we disclose apparatus which may operate in an automatic manner to remove unsightly and dangerous chips or flakes from the rim of a glass, in a simple, safe and reliable manner. Such apparatus may be particularly useful for repairing chipped crystal glassware, which tends to be rather difficult to repair effectively.

In trials of our apparatus as mentioned above, we have found it to be very effective in repairing chipped crystal glassware, much more so than any previously proposed methods and apparatus of which we are aware. However, we have continued research in an attempt to improve the apparatus, especially in terms of simplicity, reliability and economy, with a particular view to facilitating operation by relatively unskilled labour.

The present invention, at least in its preferred embodiments, aims to provide such advantages.

More generally, according to one aspect of the present invention, there is provided apparatus for grinding and/or polishing glasses, comprising:

gripping means arranged to grip a glass;

grinding and/or polishing means arranged to grind and/or polish the rim of a glass gripped in the gripping means; and transport means arranged to cause relative movement between the gripping means and the grinding and/or polishing means:

wherein:

the grinding and/or polishing means comprises an abrasive member having a substantially planar working surface disposed at such an angle that, during relative movement of the gripping means and the grinding and/or polishing means, the rim of a glass gripped in the gripping means travels over said working surface from a first to a second region thereof, the second region being closer than the first region to the base of the glass.

Said abrasive member is preferably a rotary abrasive disc.

Preferably, the arrangement is such that a glass in the gripping means engages said working surface with a resilient biassing force. This may be achieved by providing resilience in said disc itself, providing a resilient backing member for said disc which in turn is provided with flexibility, and/or providing a resilient mounting for a glass when gripped in the gripping means.

The apparatus preferably comprises at least one grinding means as aforesaid and at least one polishing means as aforesaid, the transport means being arranged to cause relative movement between the gripping means and each grinding and polishing means such that a glass gripped in the gripping means travels successively over the working surface of each grinding and polishing means.

In such an arrangement, the working surface of the or at least one of the grinding and polishing means other than the first grinding means is preferably closer to the base of a glass gripped in the gripping means, than is the working surface of the or each preceding grinding or polishing means.

Preferably, each grinding and polishing means is disposed at a fixed station, and the transport means is arranged to move a glass gripped in the gripping means in a planar path over the grinding and polishing means. For example, said path may be rectilinear or arcuate.

In a preferred arrangement, the apparatus comprises a grinding means as aforesaid and a polishing means as aforesaid, the disc of the grinding means being disposed at a first angle to the path of travel of a glass gripped in the gripping means and being provided with a first degree of resilience, and the disc of the polishing means being disposed at a second angle to the path of travel of a glass gripped in the gripping means and being provided with a second degree of resilience, said second angle being greater than said first angle, and said second degree of resilience being greater than said first degree of resilience.

There is preferably provided, adjacent the gripping means, discharge means for discharging a lubricant or coolant fluid over a glass gripped in the gripping means.

Preferably, the apparatus includes drive means for rotating a glass when gripped in the gripping means.

According to another aspect of the present invention, there is provided apparatus for grinding and/or polishing glasses, comprising:

an enclosure;

glass grinding and/or polishing means disposed within the enclosure;

access means providing access to the glass grinding and/or polishing means within the enclosure;

means for sealing the enclosure in a substantially fluid-tight manner;

a closed-circuit fluid circulation system arranged to circulate fluid throughout the enclosure during operation of the glass grinding and/or polishing means; and a reservoir for said fluid.

Said reservoir preferably comprises a removeable and/or disposable container. The apparatus may include spraying means arranged to spray fluid throughout said enclosure.

For a better understanding of the invention and to show how the same may be carried into effect, reference will now be made, by way of example, to the accompanying diagrammatic drawings, in which.

Figure 1:
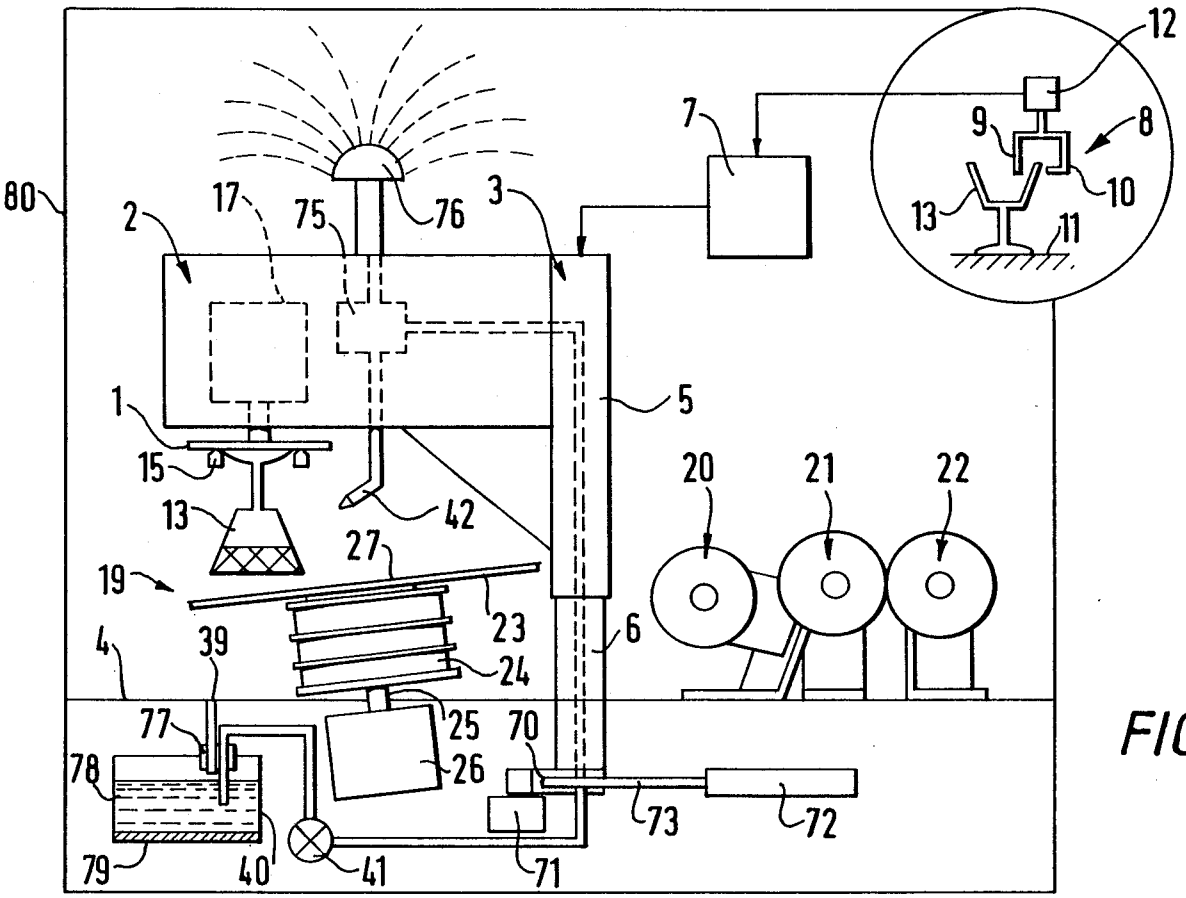
FIG. 1 is a front elevation of a glass grinding and polishing apparatus.

The illustrated apparatus comprises a gripping means in the form of a chuck 1 which is rotatably mounted upon an arm 2, which in turn is mounted upon a pillar 3, The pillar 3 is mounted on a plinth 4, for rotation about the longitudinal axis of the pillar. In this example, the plinth 4 is horizontal and the longitudinal axis of the pillar 3 is vertical.

The pillar 3 is composed of two parts 5,6 which are telescopically adjustable, under the control of a control means 7, so as to vary the height of the arm 2 and therefore the chuck 1 above the plinth 4. For example, the two parts 5,6 may be linked by, or form respective parts of, a pneumatic cylinder. Alternatively, the two parts 5,6 may interengage by means of a screwthreaded arrangement, by means of which the height of the pillar 3 is adjustable.

At the base of the pillar part 6 there is mounted a radially extending arm 70, which is retained in the illustrated position by means of a solenoid 71. A pneumatic or hydraulic actuator 72 has a rod 73 which is secured to the radial arm 70, and exerts a force to the right (as seen in FIG. 1) on the radial arm 70.

An indicator 8, comprising a first finger 9 and a second finger 10, is mounted above a table 11. The position of the indicator 8 is sensed by a sensor 12, the output of which is fed to the control means 7.

The chuck 1 comprises three jaws 14, which are spaced substantially evenly around the chuck. The jaws 14 are preferably self-centering. For example, they may be disposed at respective positions on a substantially helical track. It may be seen that the base 15 of each jaw 14 tapers inwardly. The jaws 14 are of a resilient material. Also disposed around the chuck at 120° degree intervals are three radially extending lugs 16.

Figure 3:
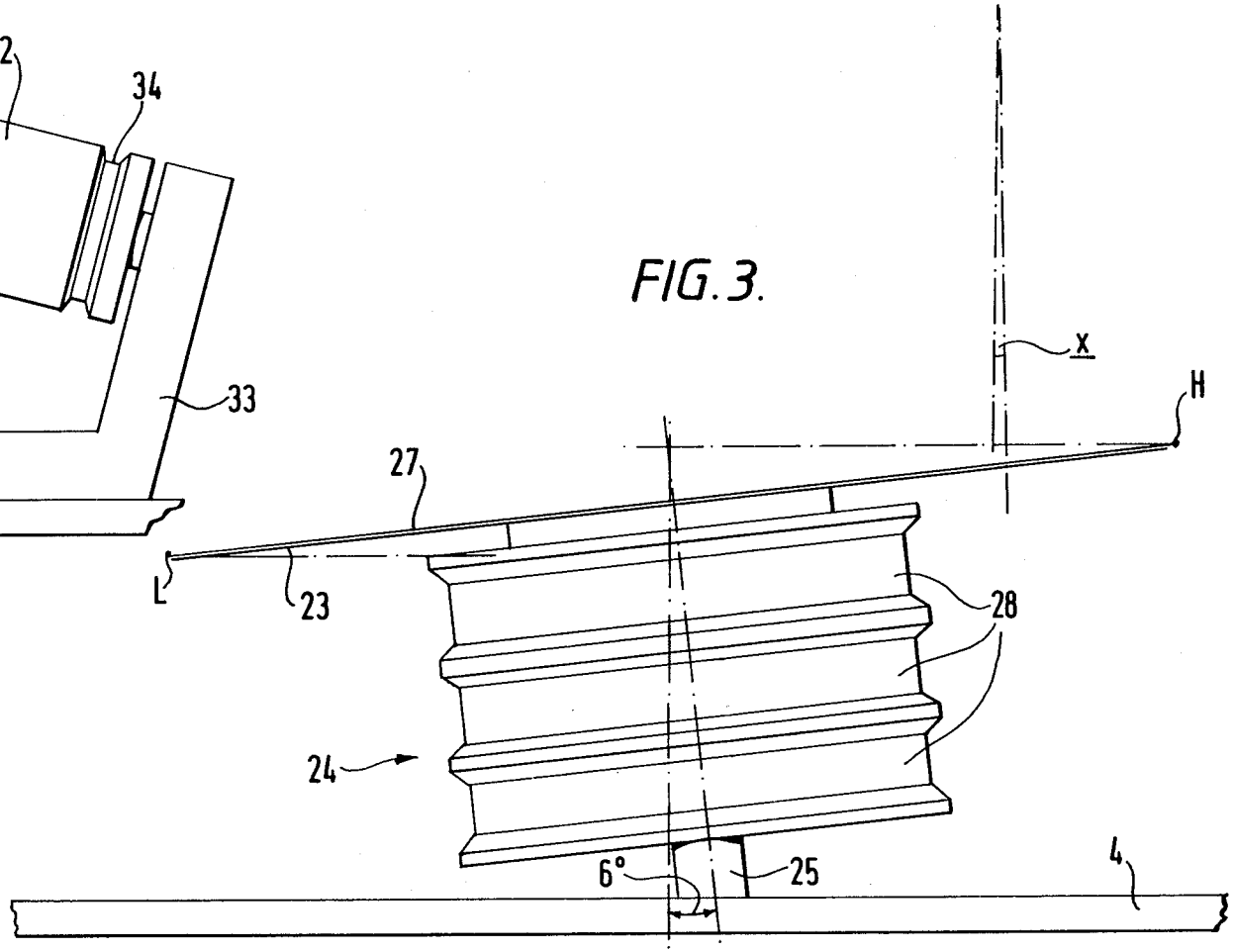
FIG. 3 is a side elevation of the grinding station.
Figure 4:
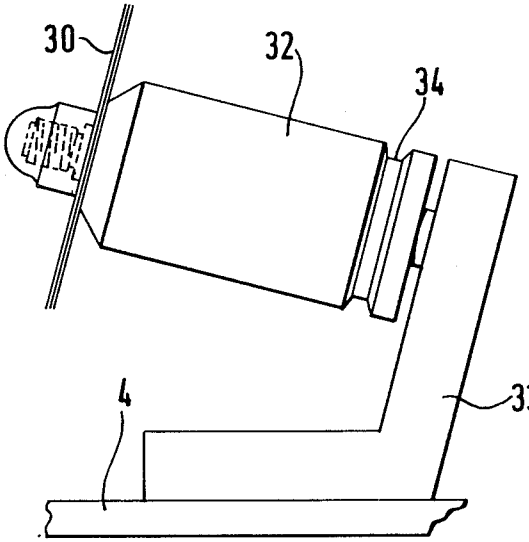
FIG. 4 is a side elevation of one of the polishing stations.
Figure 5:
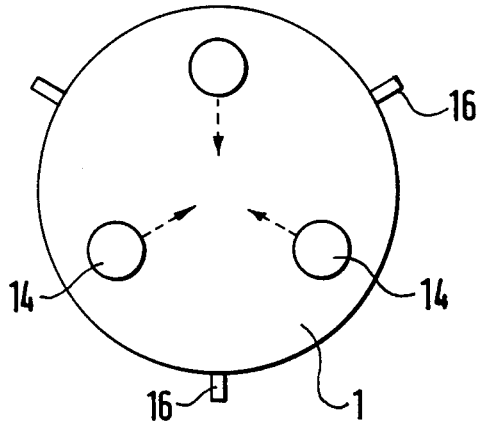
FIG. 5 is a bottom plan view of a chuck of a gripping means of the apparatus.

Mounted within the arm 2 is a drive motor 17 (shown in chain lines), for driving the chuck 1 in rotation. The axis of the output shaft of the motor 17, and therefore the longitudinal axis of a glass 13 in the chuck 1, is disposed at a small angle x to the vertical, when viewed radially inwardly from the outer end of the arm 2. This angle x is shown in FIG. 3 and may have a value of, for example, 1 degree.

Figure 2:
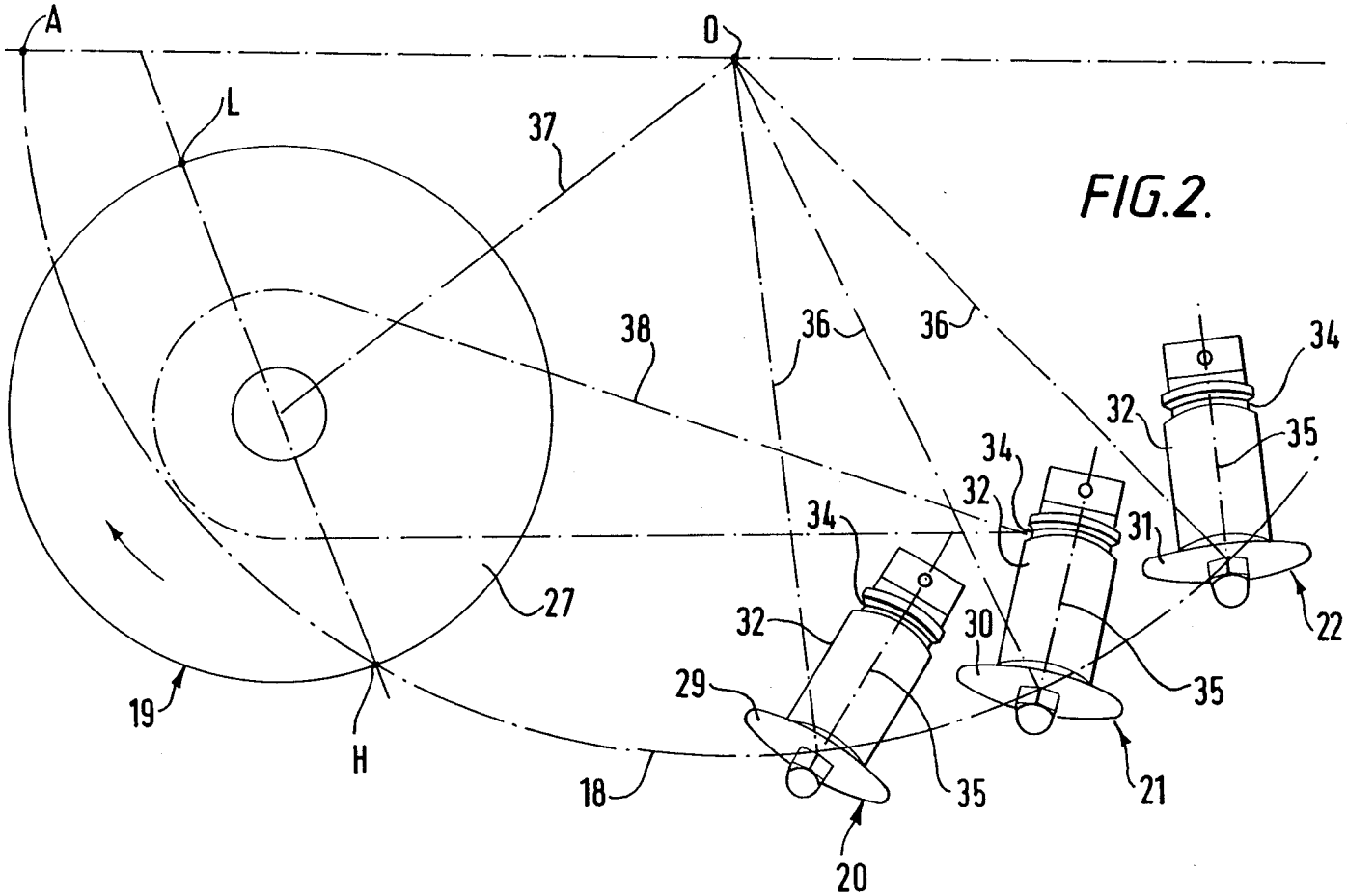
FIG. 2 is a plan view of grinding and polishing stations of the apparatus.

The arcuate path that is followed by the centre of the chuck 1, during rotation of the arm 2 about the axis of the pillar 3, is indicated in FIG. 2 by the reference 18. The starting point of the path 18 is referenced A, and the longitudinal axis of the pillar 3 is referenced O, in FIG. 2. The arcurate path 18 may end at an end point disposed diametrically opposite point A.

Disposed below the path 18 are a main grinding station 19, a secondary grinding station 20, and first and second polishing stations 21 and 22 respectively.

The main grinding station 19 comprises a resilient backing disc 23 (e.g. of thin steel), mounted for rotation at one end of a pulley 24, which in turn is mounted on the drive shaft 25 of a drive motor 26. A flexible grinding disc 27 (e.g. of 180 grit) is mounted on the backing disc 23. The pulley 24 has three identical pulley sections 28.

As may be seen in FIG. 3, the axis of the pulley 24 is disposed at an angle of 6 degrees to the vertical, such that the backing disc 23 and grinding disc 27 are disposed at an angle of 6 degrees to the horizontal. The lowest and highest points of the working surface of the disc 27 are indicated by the references L and H respectively. The line passing through L,H subtends an angle of about 70 degrees with the line AO.

The secondary grinding station 20 and the two polishing stations 21,22 are of similar construction. Each comprises a resilient grinding or polishing disc 29, 30, 31, mounted for rotation at an end of a respective shaft 32. By way of example, the discs 29,30,31 may be of 180, 600 and 1200 grit, respectively. Each shaft 32 is mounted for rotation on a respective body 33, with the longitudinal axis of the shaft 32 disposed at an angle of 14 degrees to the horizontal. Each shaft 32 is formed with a pulley portion 34, at its inner end.

The longitudinal axis 35 of each shaft 32 makes an angle of approximately 38 degrees with the respective radial line 36 that extends from the axis O of the pillar 3 to the centre of the respective disc 29, 30 or 31. The radial lines 36 are mutually spaced by angular intervals of about 20 degrees. The radial line 36 of the secondary grinding station 20 subtends an angle of about 60 degrees with the radial line 37 that extends from the axis O of the pillar 3 to the centre of the grinding disc 27 of the main grinding station 19.

By way of example, the radial line 37 may subtend an angle of about 40 degrees with the line AO.

A light flexible drive belt 38 extends from each of the pulley portions 28 to a respective one of the pulley portions 34. In the interests of clarity, only one such drive belt is shown in FIG. 2.

A drain point 39 is formed in the plinth 4, and communicates with a tank 40, for lubricant or coolant fluid. Fluid from the tank is pumped by means of a pump 41 to a discharge nozzle 42 which is mounted on the arm 2, and is adapted to discharge fluid over the glass 13 in the chuck 1. A valve 75 diverts fluid to both the discharge nozzle 42 and a spray head 76, which is operative to spray fluid throughout an enclosure 80, in which the illustrated apparatus is housed. The enclosure 80 provides a sealed housing, which prevents the escape of any fluid, during operation of the apparatus. The parts 8 to 13, shown in a roundal in FIG. 1, need not be disposed within the enclosure 80.

The tank 40 is a disposable tank—e.g. of a plastics material, and has a bung 77 through which pass the pipes leading from the drain point 39 and to the pump 41. The fluid 78 within the tank 40 contains particles, which settle as a sediment 79.

As an alternative to the spray device 76, there may be provided means for creating a forced down draught of air throughout the enclosure 80, to entrain any particles of glass, etc in the air flow. The air may then be bubbled through a tank such as the tank 40, to deposite particles therein, and thereby filter the air, which is subsequently recirculated.

The illustrated apparatus operates as follows.

Firstly, the glass 13, having a chipped rim, is placed on the table 11. The fingers 9,10 are placed on a level with the top of the rim of the glass 13, and a first measurement value recorded by the sensor 12 and control means 7. The fingers 9, 10 are then placed on a level just below the chipping on the rim, and a second measurement value recorded by the sensor 12 and control means 7. From the first and second measurement values, the control means determines the height setting of the pillar 3, and therefore the height setting of the chuck 1, corresponding to the amount of grinding required, (In practice, more than one pass may be required for a very deep chip, but it will be assumed for present purposes that this is not the case.)

The glass 13 is then inverted and placed in the chuck 1, as illustrated in FIG. 1, where it is gripped by the self-centering jaws 15. The drive motor 17 is actuated to spin the glass 13 in the chuck 1 at a speed of, for example, 120 rpm, and the pump 41 is actuated, to commence a flow of coolant through the nozzle 42 and over the spinning glass 13.

An operator presses a button to actuate the solenoid 71, which releases the radial arm 70 at the base of the pillar part 6. The force exerted by the actuator 72 then causes the arm 70 to begin to move slowly to the right (as seen in FIG. 1).

Thus, the pillar 3 is then caused to pivot slowly around its axis O, from the start position A, towards the main grinding station 19. The axis of the spinning glass follows substantially the path 18.

The drive motor is actuated to spin the grinding disc at about 3000 rpm, and the grinding and polishing stations 20, 21 and 22 each at about 9000 rpm.

At a certain point on the path 18 (dependent upon the degree of required grinding), the rim of the spinning glass 13 comes into contact with the working surface of the grinding disc 27, which commences to grind the rim of the glass. Grinding continues until the rim of the glass 13 pases over the highest point H of the disc 27, at which point the required amount of rim has been ground away.

The chuck 1 may travel between the points A and H on the path 18 in about 4 minutes.

As the chuck 1 continues its arcuate travel, the rim of the spinning glass 13 progressively contacts the grinding and polishing discs 20, 21, 22.

The secondary polishing station 20 is so arranged that the rim of the glass 13 meets the grinding disc 29 between the centre of the disc 29 and its highest point. Also, because of its shape, the rim of the glass 13 first contacts the grinding disc somewhat radially inwardly of the centre of the disc 29. This has the effect of deflecting the disc 29 backwards (i.e. towards the radially inner end of the shaft 32), whilst the glass 13 passes over the grinding station 20. Initially, the grinding disc 29 works on the outer edge of the glass rim, thereby to shape a bevel on, or to round off, the rim. As the glass continues its travel, the inner edge of its rim meets the grinding disc 29, which therefore then works on the inner edge, to bevel or round off the rim further.

As the glass 13 continues its travel further along the path 18, it passes over the polishing stations 21 and 22, where the respective polishing discs 30 and 31 work on the rim of the glass 13, to finish off the bevelled or rounded edge. The centre of the first polishing disc 30 is slightly (e.g. 2 mm) higher than that of the grinding disc 29. Similarly, the centre of the second polishing disc 31 is slightly (e.g. 2 mm) higher than that of the first polishing disc 30. Thus, each subsequent, finer polishing operation laps slightly higher than the previous grinding or polishing operation, to provide a fine, graded finish.

After the glass 13 has passed over the final polishing station, the pillar 3 continues to rotate until the chuck 1 reaches its final position, diametrically opposite the starting point A. Then, the drive motors 17 and 26 and the pump 41 stop, and the glass 13 may be removed from the chuck 1. Prior to this, final rinsing and hot air drying operations may be carried out, if desired.

After the chuck 1 has passed the point H, its speed may be increased automatically, such that it completes the remainder of its travel to its end point in about 2 minutes. Means may be provided for manually adjusting the speed of arcuate travel of the chuck 1.

As mentioned above, the enclosure 80 is preferably fluid-tight and non-vented. It may be at least partially transparent, so that operation of the apparatus may be monitored visually. It will be appreciated that, during operation of the apparatus, small particles of glass will be ground away, and these will typically have a lead content. The enclosure 80 is continually flushed by means of the fluid which is sprayed or atomized by the spray head 76, and continually circulated by the pump 41, through the tank 40. The fluid spray thus entrains particles of glass or any other material, and these are carried down to the tank 40, where they progressively settle as the sediment 79. The interior walls of the enclosure 80 are preferably flush (with no hinges, etc. protruding therefrom), to assist rinsing thereof by the fluid spray. Water may be conveniently used as the fluid, and may incorporate a wetting agent, so as to reduce surface tension and reduce the tendency for drops of fluid to remain on the interior walls of the enclosure. Also, use of a wetting agent will help to keep clean the glass 13 under repair.

After the apparatus has been used for a certain period of time, the removeable tank 40 may be taken away, disposed of without risk of pollution, and replaced by another tank.

Apart from the environmental consideration of being able to provide containment of any toxic materials within the sealed enclosure 80, the closed fluid circuit provides a further practical advantage, in that the illustrated apparatus may be made truly portable, requiring (for example) only a 13 amp power outlet, to provide power for the electric motors.

The coolant circuit may include suitable filters for the removal of particles. However, to avoid blocking of any part of the system, it may be preferred to dispense with filters. A rust inhibitor may be added to the coolant fluid. Instead of the separate pump 41, there may be provided a submersible pump within the tank 40.

The enclosure preferably has a door which is provided with an interlock device, to ensure operation of the apparatus only when the door is closed.

Experiments with prototypes of apparatus as illustrated have shown that grinding and polishing of chipped glasses may be carried out quickly, simply and economically, with a high degree of success. It will be appreciated that a low level of skill is required for operation, as all of the critical steps may be carried out under automatic control.

It is important that each grinding or polishing device has some resilience. As mentioned above, the backing plate 23 of the main grinding station 19 is preferably of a spring steel. Grinding on the working surface of the disc 27 preferably starts somewhat radially inward from the circumference, to avoid undue wear, but radially outward of the centre, to avoid any fixing nut of the backing plate 23, and to achieve significant resilience of the backing plate 23.

Conveniently, behind each disc 29, 30 and 31 thee may be disposed another two identical discs, so that each thus-formed combination of three discs exhibits an appropriate degree of flexibility and resilience. This is particularly convenient where each disc 29, 30 and 31 is cut from regular wet-and-dry abrasive paper. Alternatively, each disc 29, 30 and 31 may be of an appropriately thicker paper or backing material, or provided with its own resilient backing disc.

The discs 29, 30 and 31 generally exhibit markedly more resilience than the main grinding disc 27 on its backing plate 23.

The main grinding disc 27 may also conveniently be cut from regular wet-and-dry abrasive paper. If desired, concentric circles of abrasive material may be mounted on the plate 23—e.g. a coarser grit paper disposed concentrically within a finer grit paper—so that graded grinding occurs at the main grinding station.

Figure 6:
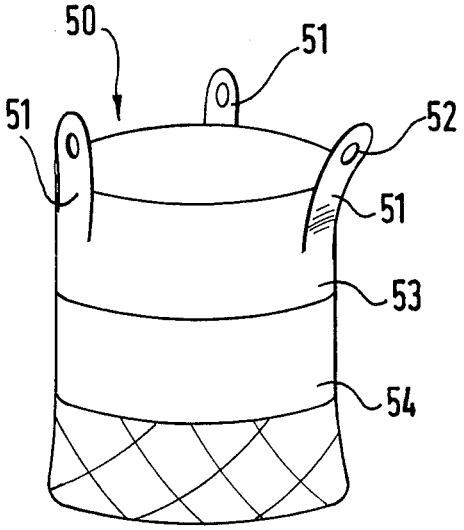
FIG. 6 is a perspective view of a tumbler fitted with an adapter.

To use the illustrated apparatus with a tumbler (i.e. a glass without a stem), one of a plurality of adapters such as the adapter 50 of FIG. 6 may be employed.

In FIG. 6, the adapter 50 comprises a collar 53 of resilient material (e.g. rubber) which fits closely around the base of a crystal tumbler 54. Flexible straps 51 extend from the collar 53 at 120 degree intervals, and each strap 51 is formed with a respective hole 52. A respective one of the lugs 16, which project radially outwardly from the chuck 1, engages in each of the holes 52, to hold the collar 53, and therefore the tumbler 54 therein, tightly against the lower surface of the chuck 1, with the tumbler 54 engaged also within the self-centering jaws 15, in a position corresponding to that of the stemmed glass 13.

Thus, the adapter 50 enables stemless tumblers to be ground and polished in just the same way as stemmed glasses. Different sized adapters such as 50 are provided, for different sizes of tumblers.

Figure 7:
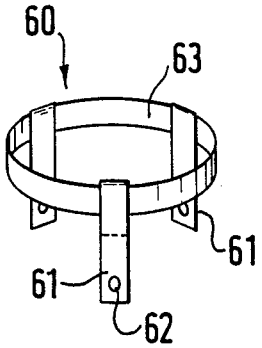
FIG. 7 is a perspective view of another adapter.
Figure 8:
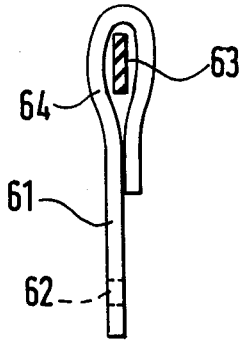
FIG. 8 is a sectional view of part of the adapter of FIG. 7.

An alternative adapter 60 is shown in FIGS. 6 and 7, and comprises three rubber straps 61 which are formed with holes 62, and are formed with loops 64 which engage around a rubber band 63. Thus, the adapter 60 is used in a manner very similar to the adapter 50, but is particularly simple to manufacture, and, for a given dimension of the rubber straps 61 and rubber band 63, may provide improved accomodation for tumblers of somewhat differing dimensions and configurations. The straps 61 may be provided with "VELCRO" (Registered Trade Mark) fastenings to secure together the respective parts of the straps 61 to form the loops 64. Alternatively, instead of the loops 64, the straps 61 may be secured directly to the rubber band 63 by means of a "VELCRO" (Registered Trade Mark) or other releasable or non-releasable fastening means.

The illustrated apparatus may be modified to grind the base of a stemmed glass, rather than the rim. In this context, it will be appreciated that the bases of glasses are equally as susceptible to chipping as the rims, and repair of a chipped base is often desirable.

In a suitable modification of the illustrated apparatus, a glass such as the glass 13 is again gripped in the chuck 1, but this time in the opposite orientation to that illustrated in FIG. 1—namely upright.

With the chuck 1 rotating, the arm 2 may be moved angularly to bring the base of the spinning glass 13 into contact with a substantially vertical grinding disc, similar to the grinding disc 27 on its resilient backing plate 23. The angular displacement of the arm 2 is accurately controlled, to achieve a desired amount of grinding of the glass base.

Thereafter, the arm 2 may be moved to subsequent grinding and/or polishing stations. These may be, for example, similar to the stations 20, 21 and 22, but with the grinding and polishing discs inclined at different angles to the horizontal, so as to provide a rounded or bevelled finish to the edge of the glass base. For example, the grinding and polishing discs may be disposed at a much smaller angle to the horizontal, and/or may be provided above and below the level of the path of travel of the glass base, so as to work on the upper and lower faces thereof.

Figure 9:
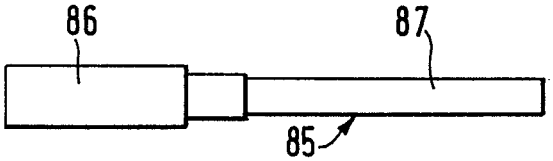
FIG. 9 and 10 show an eccentric mounting spindle in plan view and side view.
Figure 10:
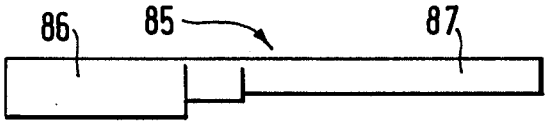

It may be found that precise adjustment of the grinding and polishing stations 20, 21, 22 is required, to afford satisfactory operation of the apparatus. To this end, each of the shafts 32 may be eccentrically mounted on its respective body 33. FIGS. 9 and 10 show one example of an eccentric spindle 85, upon which each of the shafts 32 may be mounted.

The spindle 85 has a first portion 86 which is arranged to be secured to a respective one of the bodies 33. A second spindle portion 87 extends from the first portion 86 and, as may be seen in FIGS. 9 and 10, is disposed eccentrically thereof. Thus, by rotating the spindle 85 about the centre axis of the first spindle portion 86, fine adjustment may readily be obtained, of the position of the respective shaft 32 which is mounted on the second spindle portion 87.

Figure 11:
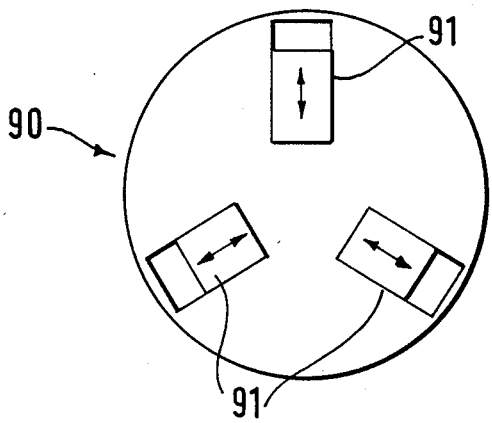
FIG. 11 is a bottom plan view of an alternative chuck.
Figure 12:
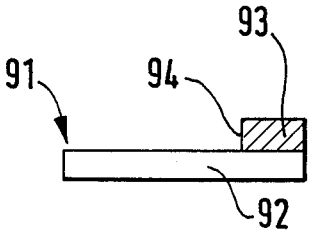
FIG. 12 is a side view of a jaw of the chuck of FIG. 11.

The chuck 90 that is illustrated in FIGS. 11 and 12 has been found to be particularly convenient in use. Its three jaw members 91 are radially adjustable in position, and preferably have a self-centering action, as previously described. In this arrangement, however, each of the jaws 91 comprises a base portion 92 of rectangular cross-section, and a jaw member 93, which is also of rectangular cross-section. In particular, each jaw member 94 has a substantially planar face, to contact the base of a glass. We have found that, somewhat surprisingly, this configuration of the jaw member 93 has been particularly effective, since the tangential contact between each jaw member 93 and the base of a respective class has been found to provide satisfactory grip, whilst largely overcoming any tendency for the base of the glass to crack, under pressure.

The base portion 92 of each jaw 91 may be of steel, and each jaw member 93 may be detachably secured thereto. For example, the jaw members 93 may be of a plastics material, and may be interchangeable with jaw members of differing shape and/or size.

Figure 13:
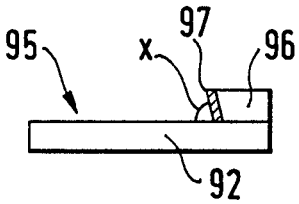
FIG. 13 is a side view similar to FIG. 12 but showing an alternative jaw.

In FIG. 13, a jaw 95 is similar to that shown in FIG. 12, but has a jaw member 96 of a different shape, defining a relatively large acute angle x, to assist retaining the base of a glass. In FIG. 13, the contact face 97 of the jaw member 96 is provided with a material of relatively high coefficient of friction, to improve grip.

The invention is not restricted to the details of the foregoing embodiment(s). The invention extends to any novel one, or any novel combination , of the features disclosed in this specification and/or drawings, or to any novel one, or any novel combination, of the steps of any method or process disclosed herein.

Features of particular novel interest in the foregoing description are the self-contained fluid circulation system, with disposable container 40, the sprinkler device 76, the chuck of FIGS. 11 to 13, the fluid tight sealing of the enclosure 80, the drive arrangement 70–73 for the pillar 3, and the fine adjustment of the shaft 32 by means of the eccentric spindles 85. However, it is to be appreciated that this is not an exclusive list of novel features of interest.

We claim:

1. Apparatus for grinding and/or polishing glasses, comprising:

gripping means arranged to grip a glass;

at least one grinding means and at least one polishing means arranged to grind and polish the rim of a glass gripped in the gripping means; and transport means arranged to cause relative movement between the gripping means and the grinding and polishing means;

wherein the grinding and polishing means each comprises an abrasive member having a resilient and substantially planar working surface disposed at such an angle that, during movement of the gripping means relative to the grinding and polishing means, the rim of a glass gripped in the gripping means travels over each said working surface from a first to a second region thereof, the second region being closer than the first region to the base of the glass.

2. Apparatus according to claim 1, wherein said abrasive member is a rotary abrasive disc.

3. Apparatus according to claim 1, including:

an enclosure;

said glass grinding and/or polishing means disposed within the enclosure;

access means providing access to the glass grinding and/or polishing means within the enclosure;

means for sealing the enclosure in a substantially fluid-tight manner;

a closed-circuit fluid circulation system arranged to circulate fluid throughout the enclosure during operation of the glass grinding and/or polishing means; and a reservoir for said fluid.

4. Apparatus according to claim 3, wherein said reservoir comprises a removeable and/or disposable container.

5. Apparatus according to claim 3, including spray means arranged to spray fluid throughout said enclosure.

6. Apparatus according to claim 1, including a grinding means as aforesaid and calibration means which is operative to co-operate with a glass to be ground, and thereby to set a desired degree of grinding to be carried out by the grinding means.

7. Apparatus for grinding and/or polishing glasses, comprising:

gripping means arranged to grip a glass;

at least one grinding means and at least one polishing means, each arranged to grind and/or polish the rim of a glass gripped in the gripping means; and transport means arranged to cause relative movement between the gripping means and the grinding and polishing means such that a glass gripped in the gripping means travels successively over the working surface of the or each grinding and polishing means:

wherein:

the grinding means and polishing means each comprise a rotary abrasive disc having a substantially planar working surface disposed at such an angle that, during relative movement of the gripping means and the grinding and/or polishing means, the rim of a glass gripped in the gripping means travels over said working surface from a first to a second region thereof, the second region being closer than the first region to the base of the glass; and the working surface of the or at least one of the grinding and polishing means other than the first grinding means is closer to the base of a glass gripped in the gripping means, than is the working surface of the or each preceding grinding or polishing means.

8. Apparatus according to claim 1, including drive means for rotating a glass when gripped in the gripping means.

9. Apparatus according to claim 7, including drive means for rotating a glass when gripped in the gripping means.

10. Apparatus according to claim 1, including control means for controlling operation of the apparatus in an automatic, pre-determined cycle.

11. Apparatus according to claim 7, including control means for controlling operation of the apparatus in an automatic, pre-determined cycle.

12. Apparatus for grinding and/or polishing glasses, comprising:

gripping means arranged to grip a glass;

at least one grinding and at least one polishing means arranged to grind and polish the rim of a glass gripped in the gripping means; and transport means arranged to cause relative movement between the gripping means and each grinding and polishing means such that a glass gripped in the gripping means travels successively over the working surface of each grinding and polishing means, and the working surface of each grinding and polishing means, other than the first grinding means, is closer to the base of a glass being gripped in the gripping means than is the working surface of each preceding grinding and polishing means:

wherein:

the grinding and polishing means comprises an abrasive member having a substantially planar working surface disposed at such an angle that, during relative movement of the gripping means and the grinding and polishing means, the rim of a glass gripped in the gripping means travels over said working surface from a first to a second region thereof, the second region being closer than the first region to the base of the glass.

13. Apparatus for grinding and/or polishing glasses, comprising:

gripping means arranged to grip a glass;

grinding and polishing means arranged to grind and polish the rim of a glass gripped in the gripping means and each comprising a disc, the disc of the grinding means being disposed at a first angle to the path of travel of a glass gripped in the gripping means and being provided with a first degree of resilience, and the disc of the polishing means being disposed at a second angle to the path of travel of a glass gripped in the gripping means and being provided with a second degree of resilience, said second angle being greater than said first angle, and said second degree of resilience being greater than said first degree of resilience; and transport means arranged to cause relative movement between the gripping means and the grinding and polishing means:

wherein:

the grinding and polishing means comprises an abrasive member having a substantially planar working surface disposed at such an angle that, during relative movement of the gripping means and the grinding and polishing means, the rim of a glass gripped in the gripping means travels over said working surface from a first to a second region thereof, the second region being closer than the first region to the base of the glass.

14. Apparatus for grinding and/or polishing glasses, comprising:

gripping means arranged to grip a glass;

at least one grinding means and at least one polishing means arranged to grind and polish the rim of a glass gripped in the gripping means; and transport means arranged to cause relative movement between the gripping means and each grinding and polishing means such that a glass gripped in the gripping means travels successively over the working surface of each grinding and polishing means;

wherein the grinding and polishing means each comprises an abrasive member having a substantially planar working surface disposed at such an angle that, during relative movement of the gripping means and the grinding and polishing means, the rim of a glass gripped in the gripping means travels over said working surface from a first to a second region thereof, the second region being closer than the first region to the base of the glass, and wherein the working surface of at least one of the grinding and polishing means other than the first grinding means is closer to the base of a glass gripped in the gripping means than is the working surface of each preceding grinding or polishing means.

15. Apparatus for grinding and/or polishing glasses, comprising:

gripping means arranged to grip a glass;

a grinding means and a polishing means arranged to grind and polish the rim of a glass gripped in the gripping means; and transport means arranged to cause relative movement between the gripping means and the grinding and polishing means;

wherein the grinding and polishing means each comprise an abrasive disc member having a substantially planar working surface disposed at such an angle that, during relative movement of the gripping means and the grinding and polishing means, the rim of a glass gripped in the gripping means travels over said working surface from a first to a second region thereof, the second region being closer than the first region to the base of the glass, and wherein the disc of the grinding means is disposed at a first angle to the path of travel of a glass gripped in the gripping means and the disc of the polishing means is disposed at a second angle to the path of travel of a glass gripped in the gripping means, said second angle being greater than said first angle.

16. Apparatus for gripping and/or polishing glasses, comprising:

gripping means arranged to grip a glass;

a grinding means and a polishing a means arranged to grind and polish the rim of a glass gripped in the gripping means; and transport means arranged to cause relative movement between the gripping means and the grinding and polishing means;

wherein the grinding and polishing means each comprise an abrasive disc member having a substantially planar working surface disposed at such an angle that, during relative movement of the gripping means and the grinding and polishing means, the rim of a glass gripped in the gripping means travels over said working surface from a first to a second region thereof, the second region being closer than the first region to the base of the glass, and wherein the disc of the grinding means is disposed at a first angle to the path of travel of a glass gripped in the gripping means and the disc of the polishing means is disposed at a second angle to the path of travel of a glass gripped in the gripping means, said second angle being greater than said first angle, and the disc of the grinding means has a first degree of resilience and the disc of the polishing means has a second degree of resilience which is greater than said first degree of resilience.

* * * * *